US007846041B2

(12) United States Patent
Beach et al.

(10) Patent No.: US 7,846,041 B2
(45) **Date of Patent: *Dec. 7, 2010**

(54) MOVABLE WEIGHTS FOR A GOLF CLUB HEAD

(75) Inventors: Todd P. Beach, San Diego, CA (US); Bing-Ling Chao, San Diego, CA (US); Mark Vincent Greaney, Vista, CA (US); Marc Kronenberg, San Diego, CA (US); Thomas Olsavsky, Oceanside, CA (US); Benoit Vincent, Encinitas, CA (US); Ian Wright, Calgary (CA); Kraig Alan Willett, Fallbrook, CA (US); Gery Mel Zimmerman, Fallbrook, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/610,154

(22) Filed: Oct. 30, 2009

(65) Prior Publication Data

US 2010/0048321 A1 Feb. 25, 2010

Related U.S. Application Data

(60) Continuation of application No. 12/002,003, filed on Dec. 12, 2007, now Pat. No. 7,632,194, which is a division of application No. 11/066,720, filed on Feb. 23, 2005, now Pat. No. 7,407,447, which is a continuation-in-part of application No. 10/785,692, filed on Feb. 23, 2004, now Pat. No. 7,166,040, which is a continuation-in-part of application No. 10/290,817, filed on Nov. 8, 2002, now Pat. No. 6,773,360.

(51) Int. Cl.
*A63B 53/04* (2006.01)
*A63B 53/06* (2006.01)

(52) U.S. Cl. ..... 473/334; 473/338; 473/345; 473/349

(58) Field of Classification Search ..... 473/324–350, 473/287–292
See application file for complete search history.

(56) References Cited

U.S. PATENT DOCUMENTS 411,000 A 9/1889 Anderson (Continued)

FOREIGN PATENT DOCUMENTS

DE 9012884 9/1990

(Continued)

OTHER PUBLICATIONS

Jackson, Jeff, The Modern Guide to Golf Clubmaking, Ohio: Dynacraft Golf Products, Inc., copyright 1994, p. 237.

(Continued)

*Primary Examiner*—Sebastiano Passaniti
(74) *Attorney, Agent, or Firm*—Klarquist Sparkman, LLP

(57) ABSTRACT

Embodiments of movable weights, such as weight assemblies and weight screws, for a golf club head are disclosed herein. One embodiment for a weight assembly, for example, comprises a mass element having a first end, a second end and a sidewall extending between the first end and the send end. The sidewall of the mass element defines a first bore extending through the mass element and at least a portion of the sidewall of mass element tapers in a direction from the first end to the second end. This embodiment further includes a retaining element configured to engage the first bore adjacent the first end of the mass element and defining a second bore. The weight assembly further includes an elongate fastener having a first end configured to be received within the second bore of the retaining element and a second end extending through the first bore and beyond the second end of the mass element when the mass element, retaining element and fastener are assembled together.

21 Claims, 9 Drawing Sheets

U.S. PATENT DOCUMENTS

| | | | |
|---|---|---|---|
| 1,133,129 | A | 3/1915 | Govan |
| 1,518,316 | A | 12/1924 | Ellingham |
| 1,526,438 | A | 2/1925 | Scott |
| 1,538,312 | A | 5/1925 | Beat |
| 1,592,463 | A | 7/1926 | Marker |
| 1,658,581 | A | 2/1928 | Tobia |
| 1,704,119 | A | 3/1929 | Buhrke |
| 1,970,409 | A | 8/1934 | Wiedemann |
| D107,007 | S | 11/1937 | Cashmore |
| 2,214,356 | A | 9/1940 | Wettlaufer |
| 2,225,930 | A | 12/1940 | Sexton |
| 2,360,364 | A | 10/1944 | Reach |
| 2,375,249 | A | 5/1945 | Richer |
| 2,460,435 | A | 2/1949 | Schaffer |
| 2,681,523 | A | 6/1954 | Seller |
| 3,064,980 | A | 11/1962 | Steiner |
| 3,466,047 | A | 9/1969 | Rodia et al. |
| 3,556,533 | A | 1/1971 | Hollis |
| 3,589,731 | A | 6/1971 | Chancellor |
| 3,606,327 | A | 9/1971 | Gorman |
| 3,610,630 | A | 10/1971 | Glover |
| 3,652,094 | A | 3/1972 | Glover |
| 3,672,419 | A | 6/1972 | Fischer |
| 3,692,306 | A | 9/1972 | Glover |
| 3,743,297 | A | 7/1973 | Dennis |
| 3,897,066 | A | 7/1975 | Belmont |
| 3,976,299 | A | 8/1976 | Lawrence et al. |
| 3,979,122 | A | 9/1976 | Belmont |
| 3,979,123 | A | 9/1976 | Belmont |
| 4,008,896 | A | 2/1977 | Gordos |
| 4,043,563 | A | 8/1977 | Churchward |
| 4,052,075 | A | 10/1977 | Daly |
| 4,076,254 | A | 2/1978 | Nygren |
| 4,085,934 | A | 4/1978 | Churchward |
| 4,121,832 | A | 10/1978 | Ebbing |
| 4,150,702 | A | 4/1979 | Holmes |
| 4,189,976 | A | 2/1980 | Becker |
| 4,214,754 | A | 7/1980 | Zebelean |
| 4,262,562 | A | 4/1981 | MacNeill |
| D259,698 | S | 6/1981 | MacNeill |
| 4,340,229 | A | 7/1982 | Stuff, Jr. |
| 4,411,430 | A | 10/1983 | Dian |
| 4,423,874 | A | 1/1984 | Stuff, Jr. |
| 4,438,931 | A | 3/1984 | Motomiya |
| 4,530,505 | A | 7/1985 | Stuff |
| D284,346 | S | 6/1986 | Masters |
| 4,602,787 | A | 7/1986 | Sugioka et al. |
| 4,607,846 | A | 8/1986 | Perkins |
| 4,730,830 | A | 3/1988 | Tilley |
| 4,754,977 | A | 7/1988 | Sahm |
| 4,795,159 | A | 1/1989 | Nagamoto |
| 4,867,457 | A | 9/1989 | Lowe |
| 4,867,458 | A | 9/1989 | Sumikawa et al. |
| 4,869,507 | A | 9/1989 | Sahm |
| 4,895,371 | A | 1/1990 | Bushner |
| 4,915,558 | A | 4/1990 | Muller |
| 4,962,932 | A | 10/1990 | Anderson |
| 4,994,515 | A | 2/1991 | Washiyama et al. |
| 5,006,023 | A | 4/1991 | Kaplan |
| 5,020,950 | A | 6/1991 | Ladouceur |
| 5,039,267 | A | 8/1991 | Wollar |
| 5,050,879 | A | 9/1991 | Sun et al. |
| 5,058,895 | A | 10/1991 | Igarashi |
| 5,122,020 | A | 6/1992 | Bedi |
| 5,244,210 | A | 9/1993 | Au |
| 5,253,869 | A | 10/1993 | Dingle et al. |
| D343,558 | S | 1/1994 | Latraverse et al. |
| 5,316,305 | A | 5/1994 | McCabe |
| 5,320,005 | A | 6/1994 | Hsiao |
| 5,328,176 | A | 7/1994 | Lo |
| 5,385,348 | A | 1/1995 | Wargo |
| 5,410,798 | A | 5/1995 | Lo |
| 5,421,577 | A | 6/1995 | Kobayashi |
| 5,429,365 | A | 7/1995 | McKeighen |
| 5,439,222 | A | 8/1995 | Kranenberg |
| 5,441,274 | A | 8/1995 | Clay |
| 5,447,309 | A | 9/1995 | Vincent |
| 5,449,260 | A | 9/1995 | Whittle |
| 5,518,243 | A | 5/1996 | Redman |
| 5,533,730 | A | 7/1996 | Ruvang |
| 5,571,053 | A | 11/1996 | Lane |
| 5,624,331 | A | 4/1997 | Lo et al. |
| 5,629,475 | A | 5/1997 | Chastonay |
| 5,632,694 | A | 5/1997 | Lee |
| 5,669,827 | A | 9/1997 | Nagamoto |
| 5,683,309 | A | 11/1997 | Reimers |
| 5,709,613 | A | 1/1998 | Sheraw |
| 5,718,641 | A | 2/1998 | Lin |
| D392,526 | S | 3/1998 | Nicely |
| 5,746,664 | A | 5/1998 | Reynolds, Jr. |
| 5,755,627 | A | 5/1998 | Yamazaki et al. |
| 5,769,737 | A | 6/1998 | Holladay et al. |
| 5,776,011 | A | 7/1998 | Su et al. |
| RE35,955 | E | 11/1998 | Lu |
| D409,463 | S | 5/1999 | McMullin |
| 5,908,356 | A | 6/1999 | Nagamoto |
| 5,911,638 | A | 6/1999 | Parente et al. |
| D412,547 | S | 8/1999 | Fong |
| 5,935,019 | A | 8/1999 | Yamamoto |
| 5,941,782 | A | 8/1999 | Cook |
| 5,947,840 | A | 9/1999 | Ryan |
| 5,967,905 | A | 10/1999 | Nakahara et al. |
| 5,997,415 | A | 12/1999 | Wood |
| 6,015,354 | A | 1/2000 | Ahn et al. |
| 6,017,177 | A | 1/2000 | Lanham |
| 6,019,686 | A | 2/2000 | Gray |
| 6,023,891 | A | 2/2000 | Robertson et al. |
| 6,032,677 | A | 3/2000 | Blechman et al. |
| 6,056,649 | A | 5/2000 | Imai |
| 6,089,994 | A | 7/2000 | Sun |
| 6,149,533 | A | 11/2000 | Finn |
| 6,162,132 | A | 12/2000 | Yoneyama |
| 6,162,133 | A | 12/2000 | Peterson |
| 6,238,303 | B1 | 5/2001 | Fite |
| 6,264,414 | B1 | 7/2001 | Hartmann et al. |
| 6,270,422 | B1 | 8/2001 | Fisher |
| 6,277,032 | B1 | 8/2001 | Smith |
| 6,296,579 | B1 | 10/2001 | Robinson |
| 6,299,547 | B1 | 10/2001 | Kosmatka |
| 6,334,817 | B1 | 1/2002 | Ezawa et al. |
| 6,348,014 | B1 | 2/2002 | Chiu |
| 6,379,265 | B1 | 4/2002 | Hirakawa et al. |
| 6,383,090 | B1 | 5/2002 | O'Doherty et al. |
| 6,390,933 | B1 | 5/2002 | Galloway et al. |
| 6,409,612 | B1 | 6/2002 | Evans et al. |
| 6,436,142 | B1 | 8/2002 | Paes et al. |
| 6,440,009 | B1 | 8/2002 | Guibaud et al. |
| 6,514,154 | B1 | 2/2003 | Finn |
| 6,524,197 | B2 | 2/2003 | Boone |
| 6,527,649 | B1 | 3/2003 | Neher et al. |
| 6,530,848 | B2 | 3/2003 | Gillig |
| 6,565,448 | B2 | 5/2003 | Cameron et al. |
| 6,641,487 | B1 | 11/2003 | Hamburger |
| 6,719,510 | B2 | 4/2004 | Cobzaru |
| 6,739,983 | B2 | 5/2004 | Helmstetter et al. |
| 6,757,572 | B1 | 6/2004 | Forest |
| 6,773,360 | B2 | 8/2004 | Willett et al. |
| 6,974,393 | B2 | 12/2005 | Caldwell et al. |
| 6,988,960 | B2 | 1/2006 | Mahaffey et al. |
| 6,991,558 | B2 | 1/2006 | Beach et al. |
| D515,165 | S | 2/2006 | Zimmerman et al. |
| 7,140,974 | B2 | 11/2006 | Chao et al. |
| 7,153,220 | B2 | 12/2006 | Lo |
| 7,163,468 | B2 | 1/2007 | Gibbs et al. |

| | | | | |
|---|---|---|---|---|
| 7,166,040 | B2 | 1/2007 | Hoffman et al. | |
| 7,169,060 | B2 | 1/2007 | Stevens et al. | |
| 7,179,034 | B2 | 2/2007 | Ladouceur | |
| 7,186,190 | B1 | 3/2007 | Beach et al. | |
| 7,223,180 | B2 | 5/2007 | Willett et al. | |
| 7,407,447 | B2 * | 8/2008 | Beach et al. | 473/324 |
| 7,632,194 | B2 * | 12/2009 | Beach et al. | 473/334 |
| 2001/0049310 | A1 | 12/2001 | Cheng et al. | |
| 2002/0022535 | A1 | 2/2002 | Takeda | |
| 2002/0032075 | A1 | 3/2002 | Vatsvog | |
| 2002/0072434 | A1 | 6/2002 | Yabu | |
| 2002/0137576 | A1 | 9/2002 | Dammen | |
| 2002/0160854 | A1 | 10/2002 | Beach et al. | |
| 2003/0130059 | A1 | 7/2003 | Billings | |
| 2004/0087388 | A1 | 5/2004 | Beach et al. | |
| 2004/0242343 | A1 | 12/2004 | Chao | |
| 2006/0058112 | A1 | 3/2006 | Haralason et al. | |

FOREIGN PATENT DOCUMENTS

| | | | |
|---|---|---|---|
| EP | 1001175 | | 5/2000 |
| GB | 194823 | | 12/1921 |
| JP | 5317465 | | 12/1993 |
| JP | 06-126004 | | 5/1994 |
| JP | 6304271 | | 11/1994 |
| JP | 09-028844 | | 2/1997 |
| JP | 9308717 | | 12/1997 |
| JP | 9327534 | | 12/1997 |
| JP | 10-234902 | | 8/1998 |
| JP | 10277187 | A | 10/1998 |
| JP | 2004 222911 | A | 8/2004 |
| WO | WO 88/02642 | | 4/1988 |
| WO | WO 01/66199 | | 9/2001 |
| WO | WO 02/062501 | | 8/2002 |
| WO | WO 03/061773 | | 7/2003 |

OTHER PUBLICATIONS

Office action dated Apr. 2, 2007 (U.S. Appl. No. 11/066,720, filed Feb. 23, 2005).

Office action dated Aug. 15, 2007 (U.S. Appl. No. 11/066,720, filed Feb. 23, 2005).

Office action dated Feb. 27, 2009 (U.S. Appl. No. 12/002,003, filed Dec. 12, 2007).

* cited by examiner

| WEIGHT SCREW | | | | | | | | | | |
|---|---|---|---|---|---|---|---|---|---|---|
| Example | Mass (g) | d1 (mm) | d2 (mm) | d3 (mm) | d4 (mm) | L1 (mm) | L2 (mm) | Material | d3/d1 | d2/d1 |
| A | 2 | 4.5 | 8.0 | 12.3 | 5.0 | 18.3 | 11.5 | 6Al-4V Ti | 2.7 | 1.8 |
| B | 3 | 7.2 | 8.0 | 12.3 | 5.0 | 19.5 | 11.5 | 6Al-4V Ti | 1.7 | 1.1 |
| C | 4 | 5.4 | 8.0 | 12.3 | 5.0 | 18.3 | 11.5 | 17-4 SST | 2.3 | 1.5 |
| D | 5 | 6.8 | 8.0 | 12.3 | 5.0 | 19.5 | 11.5 | 17-4 SST | 1.8 | 1.2 |

FIG. 9a

| WEIGHT ASSEMBLY SCREW | | | | | | | |
|---|---|---|---|---|---|---|---|
| Example | Mass (g) | d5 (mm) | d6 (mm) | d7 (mm) | L3 (mm) | L4 (mm) | Material |
| E | 6 | 7.4 | 6.0 | 5.0 | 5.5 | 16.2 | 17-4 SST |
| F | 7 | 7.4 | 6.0 | 5.0 | 5.5 | 16.2 | 17-4 SST |
| G | 8 | 7.4 | 6.0 | 5.0 | 5.5 | 16.2 | 17-4 SST |
| H | 9 | 7.4 | 6.0 | 5.0 | 5.5 | 16.2 | 17-4 SST |
| I | 10 | 7.4 | 6.0 | 5.0 | 5.5 | 16.2 | 17-4 SST |
| J | 11 | 7.4 | 6.0 | 5.0 | 5.5 | 16.2 | 17-4 SST |
| K | 12 | 7.4 | 6.0 | 5.0 | 5.5 | 21.7 | 17-4 SST |
| L | 13 | 7.4 | 6.0 | 5.0 | 5.5 | 21.7 | 17-4 SST |
| M | 14 | 7.4 | 6.0 | 5.0 | 5.5 | 21.7 | 17-4 SST |
| N | 15 | 7.4 | 6.0 | 5.0 | 5.5 | 21.7 | 17-4 SST |
| O | 16 | 7.4 | 6.0 | 5.0 | 5.5 | 21.7 | 17-4 SST |
| P | 17 | 7.4 | 6.0 | 5.0 | 5.5 | 21.7 | 17-4 SST |
| Q | 18 | 7.4 | 6.0 | 5.0 | 5.5 | 21.7 | 17-4 SST |
| R | 19 | 7.4 | 6.0 | 5.0 | 5.5 | 21.7 | 17-4 SST |
| S | 20 | 7.4 | 6.0 | 5.0 | 5.5 | 21.7 | 17-4 SST |
| T | 21 | 7.4 | 6.0 | 5.0 | 5.5 | 21.7 | 17-4 SST |
| U | 22 | 7.4 | 6.0 | 5.0 | 5.5 | 21.7 | 17-4 SST |
| V | 23 | 7.4 | 6.0 | 5.0 | 5.5 | 21.7 | 17-4 SST |
| W | 24 | 7.4 | 6.0 | 5.0 | 5.5 | 21.7 | 17-4 SST |
| X | 25 | 7.4 | 6.0 | 5.0 | 5.5 | 21.7 | 17-4 SST |

FIG. 10b

| WEIGHT ASSEMBLY MASS ELEMENT | | | | | | | | | | | |
|---|---|---|---|---|---|---|---|---|---|---|---|
| Example | Mass (g) | d8 (mm) | d9 (mm) | d10 (mm) | d11 (mm) | d12 (mm) | L5 (mm) | L6 (mm) | L7 (mm) | L8 (mm) | Material |
| E | 6 | 12.8 | 10.0 | 6.0 | 11.6 | 6.0 | 0.0 | 4.5 | 6.7 | 0.0 | 6Al-4V Ti |
| F | 7 | 12.8 | 10.0 | 9.3 | 11.2 | 6.0 | 0.0 | 4.5 | 9.0 | 2.0 | 6Al-4V Ti |
| G | 8 | 12.8 | 10.0 | 9.3 | 11.2 | 6.0 | 0.0 | 4.5 | 9.0 | 2.4 | 18-8 SST |
| H | 9 | 12.8 | 10.0 | 9.3 | 11.2 | 6.0 | 0.0 | 4.5 | 9.0 | 2.6 | Tungsten |
| I | 10 | 12.8 | 10.0 | 6.0 | 11.2 | 6.0 | 0.0 | 4.5 | 9.0 | 0.0 | Tungsten |
| J | 11 | 12.8 | 10.0 | 6.0 | 11.2 | 6.0 | 1.0 | 4.5 | 13.5 | 0.0 | Tungsten |
| K | 12 | 12.8 | 10.0 | 6.0 | 11.2 | 6.0 | 1.4 | 4.5 | 13.5 | 0.0 | Tungsten |
| L | 13 | 12.8 | 10.0 | 6.0 | 11.2 | 6.0 | 2.4 | 4.5 | 13.5 | 0.0 | Tungsten |
| M | 14 | 12.8 | 10.0 | 6.0 | 11.2 | 6.0 | 3.4 | 4.5 | 13.5 | 0.0 | Tungsten |
| N | 15 | 12.8 | 10.0 | 6.0 | 11.2 | 6.0 | 2.0 | 4.5 | 13.5 | 0.0 | Tungsten |
| O | 16 | 12.8 | 10.0 | 6.0 | 11.2 | 6.0 | 2.0 | 4.5 | 13.5 | 0.0 | Tungsten |
| P | 17 | 12.8 | 10.0 | 6.0 | 11.2 | 6.0 | 2.0 | 4.5 | 13.5 | 0.0 | Tungsten |
| Q | 18 | 12.8 | 10.0 | 6.0 | 11.2 | 6.0 | 2.0 | 4.5 | 13.5 | 0.0 | Tungsten |
| R | 19 | 12.8 | 10.0 | 6.0 | 11.2 | 6.0 | 5.5 | 4.5 | 13.5 | 0.0 | Tungsten |
| S | 20 | 12.8 | 10.0 | 6.0 | 11.2 | 6.0 | 5.5 | 4.5 | 13.5 | 0.0 | Tungsten |
| X | 25 | 12.8 | 10.0 | 6.0 | 11.2 | 6.0 | 5.5 | 4.5 | 13.5 | 0.0 | Tungsten |

FIG. 10d

MOVABLE WEIGHTS FOR A GOLF CLUB HEAD

CROSS REFERENCE TO RELATED APPLICATIONS

The present application is a continuation of U.S. patent application Ser. No. 12/002,003, filed Dec. 12, 2007, now U.S. Pat. No. 7,632,194, which is a divisional application of U.S. patent application Ser. No. 11/066,720, filed Feb. 23, 2005, now U.S. Pat. No. 7,407,447, which is a continuation-in-part of U.S. patent application Ser. No. 10/785,692, filed Feb. 23, 2004, now U.S. Pat. No. 7,166,040, which is a continuation-in-part of U.S. patent application Ser. No. 10/290,817, filed Nov. 8, 2002, now U.S. Pat. No. 6,773,360. These applications are incorporated herein by this reference.

FIELD

The present application is directed to weights for a golf club head, particularly movable weights for a golf club head.

BACKGROUND

The center of gravity (CG) of a golf club head is one critical parameter of the club's performance. Upon impact, the position of the CG greatly affects launch angle and flight trajectory of a struck golf ball. Thus, much effort has been made over positioning the center of gravity of golf club heads. To that end, current driver and fairway wood golf club heads are typically formed of lightweight, yet durable materials, such as steel or titanium alloys. These materials are typically used to form thin club head walls. Thinner walls are lighter, and thus result in greater discretionary weight, i.e., weight available for redistribution around a golf club head. Greater discretionary weight allows golf club manufacturers more leeway in assigning club mass to achieve desired golf club head mass distributions.

Various approaches have been implemented for positioning discretionary mass about a golf club head. Many club heads have integral sole weight pads cast into the head at predetermined locations to lower the club head's center of gravity. Also, epoxy may be added to the interior of the club head through the club head's hosel opening to obtain a final desired weight of the club head. To achieve significant localized mass, weights formed of high-density materials have been attached to the sole. With these weights, the method of installation is critical because the club head endures significant loads at impact with a golf ball, which can dislodge the weight. Thus, such weights are usually permanently attached to the club head and are limited in total mass. This, of course, permanently fixes the club head's center of gravity.

Golf swings vary among golfers, but the total weight and center of gravity location for a given club head is typically set for a standard, or ideal, swing type. Thus, even though the weight may be too light or too heavy, or the center of gravity is too far forward or too far rearward, the golfer cannot adjust or customize the club weighting to his or her particular swing. Rather, golfers often must test a number of different types and/or brands of golf clubs to find one that is suited for them. This approach may not provide a golf club with an optimum weight and center of gravity and certainly would eliminate the possibility of altering the performance of a single golf club from one configuration to another and then back again.

It should, therefore, be appreciated that there is a need for a system for adjustably weighting a golf club head that allows a golfer to fine-tune the club head to accommodate his or her swing. The present application fulfills this need and others.

SUMMARY

Disclosed below are representative embodiments that are not intended to be limiting in any way. Instead, the present disclosure is directed toward novel and nonobvious features, aspects, and equivalents of the embodiments of the movable weights of a golf club head described below. The disclosed features and aspects of the embodiments can be used alone or in various novel and nonobvious combinations and sub-combinations with one another.

One of the disclosed movable weights embodiments is for a weight assembly for a golf club head. For example, a weight assembly of this embodiment comprises a mass element having a first end, a second end and a sidewall extending between the first end and the second end. The sidewall of the mass element defines a first bore extending through the mass element and at least a portion of the sidewall of mass element tapers in a direction from the first end to the second end. This embodiment further includes a retaining element configured to engage the first bore adjacent the first end of the mass element and defining a second bore. The weight assembly further includes an elongate fastener having a first end configured to be received within the second bore of the retaining element and a second end extending through the first bore and beyond the second end of the mass element when the mass element, retaining element and fastener are assembled together.

The first bore of the mass element may be a stepped bore with a first diameter at the first end of the mass element and a second diameter that is smaller than the first diameter at the second end of the mass element. The first bore transitions from the first diameter to the second diameter at some location between the first end and the second end of the mass element. An annular engagement surface may be included in the bore at an area where the first bore transitions from the first to the second diameter and may have an outer diameter approximately equal to the first diameter and an inner diameter approximately equal to the second diameter. In some implementations, the second diameter is approximately 6 mm.

In other implementations, the elongate fastener includes a head portion that is configured to engage the annular engagement surface when the mass element, retaining element and fastener are assembled together and the fastener is tightened to retain the weight assembly in the golf club head. In other implementations, the second diameter of the first bore is sized to allow the second end of the fastener to freely rotate. The first bore may also have a first segment extending from the first end and a second segment extending from the second end where the first segment is internally threaded and the second segment is substantially non-threaded. In some implementations, the portion of the sidewall that tapers from the first end to the second end is tapered at an angle of approximately 95 degrees.

The mass element may have a conical frustum shape and may have a generally circular, triangular, hexagonal, oval or rectangular cross-sectional shape. In some implementations, the mass element is made from a tungsten, brass, steel, or titanium material. In other implementations, the mass element has a uniform or non-uniform density and may have a low friction element or substance disposed between the fastener head and the retaining element.

The retaining element of the weight assembly may have external threads and the first end of the first bore may have corresponding internal threads. The internal threads may have an outer diameter of about 10 mm and a thread pitch of about 1.0. In some implementations, the second bore of the retaining element may include an outer end opening, an inner end opening and a transition section positioned between the outer end opening and the inner end opening. The outer end opening of the retaining element may be dimensioned to receive the head end portion of the fastener and the inner end opening may be dimensioned to receive a peripheral rim formed in the head portion. In some embodiments, the outer end opening is approximately 6.0 mm and the inner end opening is approximately 8.0 mm. The retaining element may, in some implementations, have an outermost diameter approximately equal to an outermost diameter of the first end of the mass element. The outermost diameters may be between about 11 mm and about 13 mm. In other implementations the retaining element has an outer end surface that is slightly dome shaped. The retaining element may also have markings on an outer end surface corresponding to mass characteristics of the weight assembly. In some embodiments, the retaining element is made from steel. The outer end surface may also be configured to engage with a tool for securing the retaining element to the mass element.

The fastener of the weight assembly may have a recess in the head portion configured to engage a tool for rotating the fastener head. The recess may have multiple lobes and corresponding flutes to facilitate engagement with the tool. The recess may also have a post positioned within the recess and configured to facilitate engagement with the tool. In some implementations, the fastener may have a threaded body portion extending from a head portion of the fastener proximate the first end of the fastener to approximately the second end of the fastener. In some implementations, the threaded body portion has threads with an outer diameter of approximately 5 mm and a thread pitch of approximately 0.8. The peripheral rim of the fastener may have a diameter of approximately 4 mm and an axial dimension of approximately 2 mm. The fastener head extending from the peripheral rim may have a diameter of approximately 6 mm and a axial dimension of approximately 3.5 mm. In some implementations, the fastener is made from steel.

In some implementations, when the mass element, the retaining element and the fastener are assembled together, the fastener is free to rotate and to move in an axial direction but is captured by the peripheral rim within a space defined by the transition section of the second bore in a first direction and by the transition section in the first bore in a second direction. The weight assembly may be configured to be removably engaged with the golf club head and sized to enclose a corresponding weight recess formed in the golf club head. In some implementations the mass element is configured to be press-fit within the weight recess.

A mass of the disclosed weight assembly may be between approximately 1 gram and approximately 25 grams.

In some implementations of this embodiment, the weight assembly may include a sleeve in contact with and at least partially surrounding an outer surface of the sidewall. The mass element may be made of a first material and the sleeve may be made of a second material where the second material has a higher density than the first material. The golf club head can be made of a third material having a density approximately the same as the second material. The sleeve may be made from a steel and the mass element may be made from tungsten. The sleeve can be bonded to the mass element using an adhesive. In other implementations, the outer surface of the mass element includes a sleeve receiving portion where the sleeve substantially surrounds the sleeve receiving portion.

In other implementations of this embodiment, the weight assembly may include a washer or other similar structure positioned within the first bore. The washer is sized to receive the second end of the fastener. In more specific implementations, the washer is positioned within the first bore between the annular engagement surface and the head portion of the fastener. The head portion of the fastener abuts a first major surface of the washer and the annular engagement surface abuts a second major surface of the washer when the fastener is tightened to retain the weight assembly on the golf club head. The washer can be made from a steel and include a first major surface and a second major surface each having a surface finish of approximately 1.0 microns.

In still other implementations of this embodiment, the weight assembly may include a coating of an elastomeric material bonded to at least a portion the tapered portion of the mass element sidewall. The coating may have a thickness between about 0.15 mm and about 4.0 mm, and the elastomeric material may have a hardness between about 20 shore A and about 70 shore D.

Another of the disclosed movable weights embodiments is for a weight screw for a golf club head. A weight screw of this embodiment may have a head with having a socket configured for engagement with a tool for securing the weight screw to the golf club head. The weight screw further includes a body having a first end connected to the head and a second end. The weight screw includes a stop connected to the second end of the body and having a stop lateral dimension. The weight screw of this embodiment also has a threaded portion connected to the stop and having a thread diameter less than the stop lateral dimension.

In some implementations, the weight screw body has a diameter and the head has a diameter. The diameter of the body can be less than the diameter of the head and the lateral dimension of the stop. The diameter of the head can be greater than the lateral dimension of the stop.

The weight screw has a total weight screw mass equal to the combined masses of the head, body, stop and threaded portion. In some implementations, the total weight screw mass is between approximately 1 gram and 5 grams. In specific implementations, the total weight screw mass is approximately 2 grams. In other specific implementations, the total weight screw mass is changed by changing the mass of the body. The body may have a cross-sectional maximum dimension between about 4 mm and about 8 mm.

The weight screw may have length between approximately 18 mm and approximately 20. In some implementations, the weight screw head may be sized to enclose a corresponding weight recess formed in the golf club head and have an outermost diameter between about 11 mm and about 13 mm. An outer end surface of the weight screw head may have markings thereon corresponding to mass characteristics of the weight screw. The weight screw head socket may have multiple lobes and corresponding flutes to facilitate engagement with the tool and a centrally located post to facilitate engagement with the tool.

In some implementations, the weight screw stop may be positioned on the weight screw at a distance of about 11 mm from the outer end surface of the weight screw head. The stop may have a stop maximum dimension of about 6 mm. In some implementations, the stop maximum dimension is a stop maximum diameter.

In some implementations, the weight screw threaded portion has threads with a thread diameter of about 5 mm. The weight screw may be made from a titanium or steel and may be configured to be removably engaged with the golf club head.

One disclosed method of assembling a weight assembly for a golf club head includes providing a mass element with a first end, a second end and a sidewall extending between the first end and the second end. A portion of the sidewall tapers from the first end to the second end and the sidewall defines a first bore extending through the mass element. The method further includes inserting an elongate fastener having a head and a body into the first bore of the mass element such that at least a portion of the body extends through the first bore and beyond the second end of the mass element. This method can further include attaching a retaining element to the first bore adjacent the first end of the mass element, the retaining element defining a second bore. At least a portion of the fastener head is captured by the second bore of the retaining element in a first direction and by the first bore of the mass element in a second direction. In this way, the axial movement of the fastener is restricted. Generally, the fastener is rotatable relative to the mass element and the retaining element.

In some methods, the first bore in the mass element may be a stepped bore having a first diameter at the first end and a second diameter smaller than the first diameter at the second end and the first bore may have an annular engagement where the first bore transitions from the first diameter to the second diameter. The second bore in the retaining element may be a stepped bore having an outer end opening and an inner end opening larger than the outer end opening and the second bore may have an annular engagement where the second bore transitions from the inner end opening to the outer end opening. In some methods, at least a portion of the fastener head may have a peripheral rim having a major dimension greater than the second diameter of the first bore and the outer end opening of the second bore. The peripheral rim may be captured between the annular engagement of the first bore and the annular engagement of the second bore. In other implementations, the mass element may have internal threads and the retaining element may have corresponding external threads. Attaching the retaining element to the first bore adjacent the first end of the mass element may include rotatably engaging the external threads of the retaining element with the internal threads of the mass element. In some implementations, a coating of a rubber material is bonded to at least a portion the tapered portion of the mass element sidewall.

In other implementations, the method may include attaching a sleeve having a tapered sidewall corresponding to the tapered portion of the mass element sidewall to an outer surface of the sidewall of the mass element.

In other implementations, the method may include positioning a washer within the first bore such that the body of the fastener extends through the washer and the head of the fastener is prevented from extending through the washer.

Another method of attaching a weight assembly to a golf club head includes providing a weight assembly having a mass element with first bore extending through the mass element and an side surface tapering from a first end of the mass element to a second end of the mass element. The weight assembly also includes a retaining element configured to engage the bore adjacent the first end of the mass element and defining a bore. Additionally, the weight assembly includes an elongate fastener with a first end configured to be received within the second bore of the retaining element and a second end extending through the first bore and beyond the second end of mass element when the mass element, retaining element and fastener are assembled together. The fastener also includes a peripheral rim positioned between the first end and second end. The method also includes positioning the weight assembly within a recess formed in the golf club head. The recess of this embodiment has a tapering receiving surface corresponding with the tapering side surface of the mass element. The method further includes threadably engaging threads formed in at least the portion of the fastener extending through the first bore with corresponding threads formed in the recess of the golf club head such that the peripheral rim of the fastener engages a portion of the first bore and the tapering side surface of the mass element directly abuts the tapering receiving surface of the recess. This implementation also includes press-fitting the mass element into the recess by rotating the fastener in a first direction.

In some implementations, the method may further include rotating the fastener in a second direction opposite the first direction such that the peripheral rim of the fastener engages a portion of the second bore. Further rotation of the fastener in the second direction causes the mass element to dislodge from the recess of the golf club head.

Another movable weights embodiment is for a weight assembly for a golf club head including a mass, first aperture with a first diameter formed in the mass, a second aperture with a second diameter formed in the mass, a cavity formed in the mass and a fastener having a fastener head and a fastener body. In this implementation, the first and second apertures are coupled to the cavity. The fastener head has a third diameter that is greater than the first and second diameters. Additionally, the fastener head is disposed in the cavity and the fastener body extends through the second aperture.

The foregoing and additional features and advantages of the disclosed embodiments will become more apparent from the following detailed description, which proceeds with reference to the following drawings.

BRIEF DESCRIPTION OF THE DRAWINGS

FIG. 9*a* is a chart showing mass, material and dimension characteristics of various exemplary embodiments of weight screws.

FIG. 10*b* is a chart showing mass, material and dimension characteristics of screws of various exemplary embodiments of weight assemblies.

FIG. 10*d* is a chart showing mass, material and dimension characteristics of mass elements of various exemplary embodiments of weight assemblies.

DETAILED DESCRIPTION

Disclosed below are representative embodiments that are not intended to be limiting in any way. Instead, the present disclosure is directed toward novel and nonobvious features, aspects and equivalents of the embodiments of the golf club information system described below. The disclosed features and aspects of the embodiments can be used alone or in various novel and nonobvious combinations and sub-combinations with one another.

Figure 1:
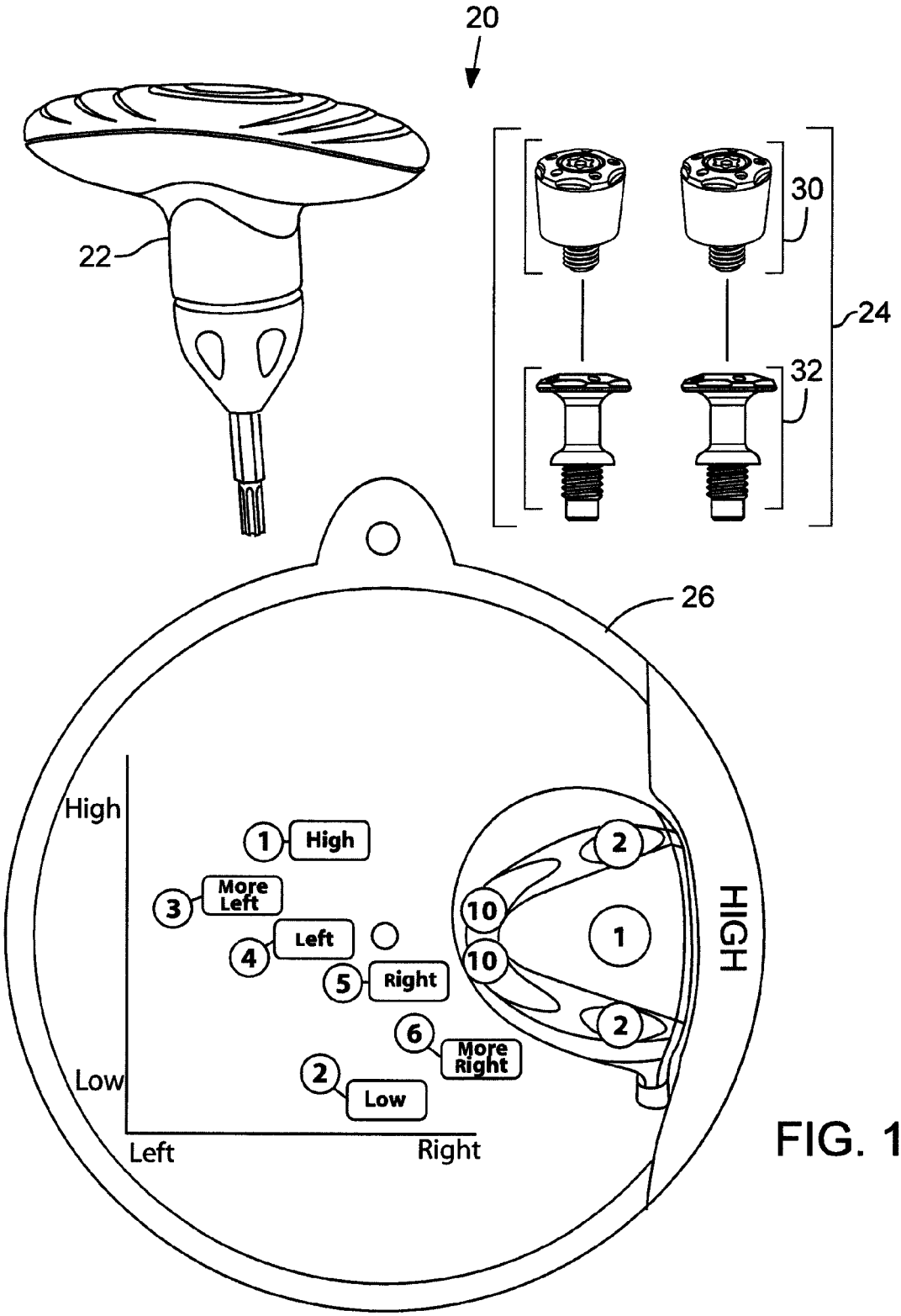
FIG. 1 is a perspective view of an embodiment of a kit for adjustably weighting a golf club head in accordance with the invention.

Now with reference to the illustrative drawing, and particularly FIG. 1, there is shown a kit 20 having a driving tool, i.e., torque wrench 22, and a set of weights 24 usable with a golf club head having conforming recesses and an instruction wheel 26.

An exemplary club head 28 includes four recesses, e.g., weight ports 96, 98, 102, 104, disposed about the periphery of the club head 28 (FIGS. 2-5). In the exemplary embodiment, four weights 24 are provided: two weight assemblies 30 of about ten grams and two weight screws 32 of about two grams. Although the exemplary embodiment includes four weights 24, two of which are weight assemblies 30 and two of which are weight screws 32, "weights" as used herein, can refer to any number of weights 24, including one or more weight assemblies 30, or one or more weight screws 32, or any combination thereof. In most embodiments, there is one of the weights for each of the weight ports 96, 98, 102, 104.

Varying placement of the weights within weight ports 96, 98, 102 and 104 enables the golfer to vary launch conditions of a golf ball struck by the club head 28, for optimum distance and accuracy. More specifically, the golfer can adjust the position of the club head's center of gravity (CG), for greater control over the characteristics of launch conditions and, therefore, the trajectory and shot shape of a struck golf ball.

With reference to FIGS. 1-5, the weights 24 are sized to be securely received in any of the four weight ports 96, 98, 102, 104 of the club head 28, and are secured in place using the torque wrench 22. The weight assemblies 30 preferably stay in place via a press fit. Weights 24 are configured to withstand forces at impact, while also being easy to remove. The instruction wheel 26 aids the golfer in selecting a proper weight configuration for achieving a desired effect to the trajectory and shape of the golf shot. In some embodiments, the kit 20 provides six different weight configurations for the club head 28, which provides substantial flexibility in positioning the CG of the club head 28. In the exemplary embodiment, the CG of the club head 28 can be adjustably located in an area adjacent to the sole having a length of about five millimeters measured from front-to-rear and width of about five millimeters measured from toe-to-heel. Each configuration delivers different launch conditions, including ball launch angle, spin-rate and the club head's alignment at impact, as discussed in detail below.

Each of the weight assemblies 30 (FIGS. 10-12) includes a mass element 34, a fastener, e.g., screw 36, and a retaining element 38. In the exemplary embodiment, the weight assemblies 30 are preassembled; however, component parts can be provided for assembly by the user.

Figure 9:
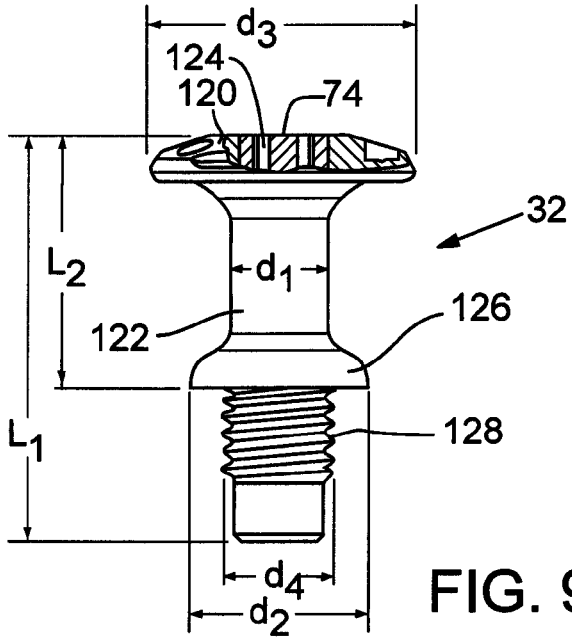
FIG. 9 is a side elevational view of a weight screw of the kit of FIG. 1.

For weights having a total mass between about one gram and about two grams, weights screws 32 without a mass element preferably are used (FIG. 9). The weight screws 32 can be made from any suitable material, including steel or titanium in some implementations and can have a head 120 with an outermost diameter sized to conform to any of the four weight ports 96, 98, 102, 104 of the club head 28.

The kit 20 can be provided with a golf club at purchase, or sold separately. For example, a golf club can be sold with the torque wrench 22, the instruction wheel 26, and the weights 24 (e.g., two 10-gram weight assemblies 30 and two 2-gram weight screws 32) preinstalled. Kits 20 having an even greater variety of weights can also be provided with the club, or sold separately. In another embodiment, a kit 20 having eight weights 24 is contemplated (e.g., a 2-gram weight screw 32, four 6-gram weight assemblies 30, two 14-gram weight assemblies 30, and an 18-gram weight assembly 30. Such a kit 20 may be particularly effective for golfers with a fairly consistent swing, by providing additional precision in weighting the club head 28.

Also, weights in prescribed increments across a broad range can be available. For example, weights 24 in one gram increments ranging from one gram to twenty-five grams can provide very precise weighting, which would be particularly advantageous for advanced and professional golfers. In some embodiments, the weight assembly has a mass between about 1 gram and about 25 grams. In more specific embodiments, the weight assembly has a mass between about 1 gram and about 5 grams, between about 5 grams and about 10 grams, between about 10 grams and about 15 grams or between about 15 grams and about 25 grams. In certain embodiments, weight assemblies 30 ranging between five grams and ten grams preferably use a mass element 34 comprising primarily a titanium alloy. Weight assemblies 30 ranging between ten grams to over twenty-five grams, preferably use a mass element 34 comprising a tungsten-based alloy, or blended tungsten alloys. The mass element 34 can be made from any other suitable material, including, but not limited to, brass, steel, titanium or combinations thereof, to achieve a desired weight mass. Furthermore, the mass element 34 can have a uniform or non-uniform density. The selection of material may also require consideration of other requirements such as durability, size restraints, and removability.

Instruction Wheel

Figure 6:
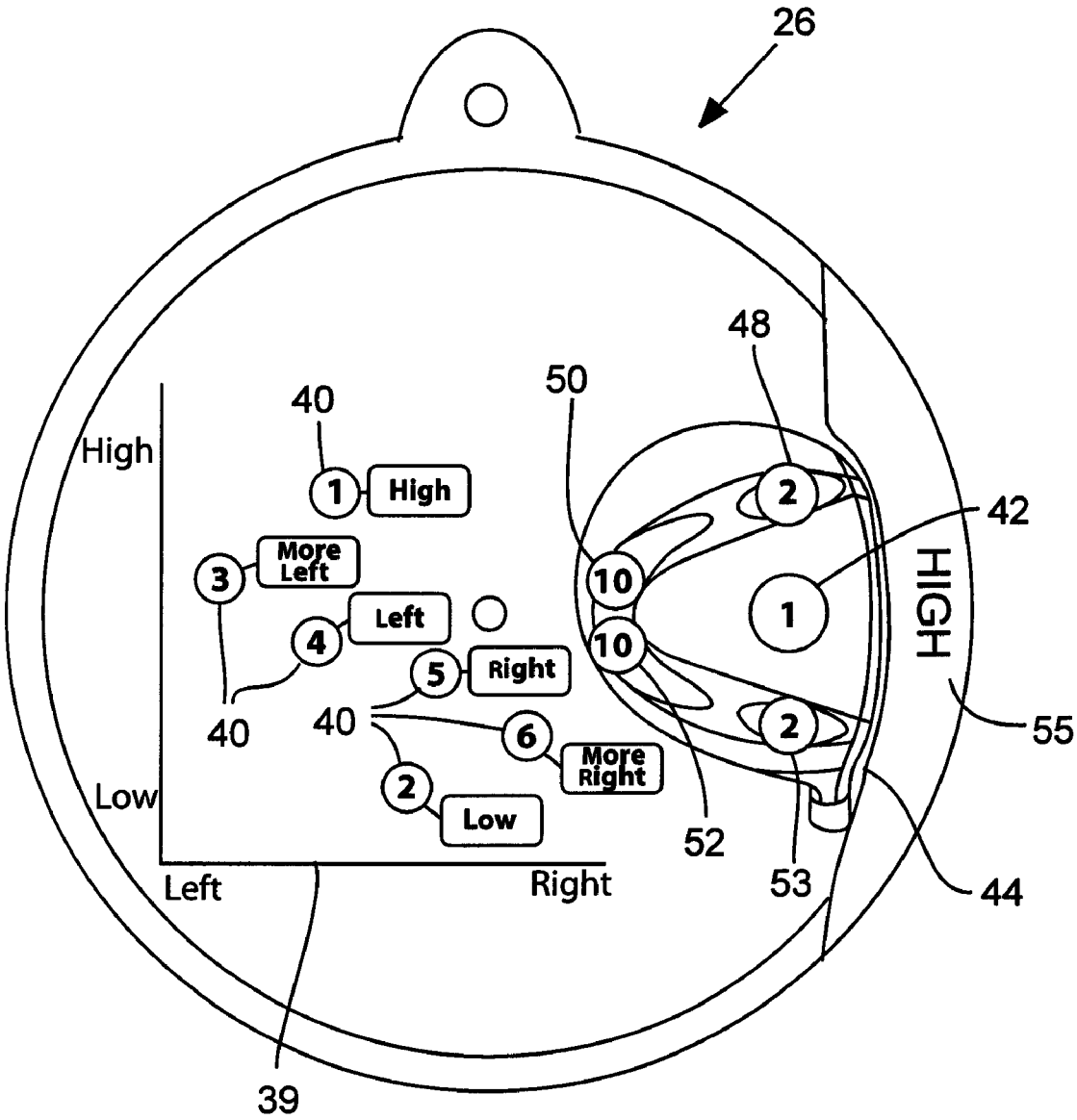
FIG. 6 is a plan view of the instruction wheel of the kit of FIG. 1.

With reference now to FIG. 6, the instruction wheel 26 aids the golfer in selecting a club head weight configuration to achieve a desired effect on the motion path of a golf ball struck by the golf club head 28. The instruction wheel 26 provides a graphic, in the form of a motion path chart 39 on the face of instruction wheel 26 to aid in this selection. The motion path chart's y-axis corresponds to the height control of the ball's trajectory, generally ranging from low to high. The x-axis of the motion path chart corresponds to the directional control of the ball's shot shape, ranging from left to right. In the exemplary embodiment, the motion path chart 39 identifies six different weight configurations 40. Each configuration is plotted as a point on the motion path chart 39. Of course, other embodiments can include a different number of configurations, such as, for kits having a different variety of weights. Also, other approaches for presenting instructions to the golfer can be used, for example, charts, tables, booklets, and so on. The six weight configurations of the exemplary embodiment are listed below in Table 1.

TABLE 1

| Config. | | Weight Distribution | | | |
|---|---|---|---|---|---|
| No. | Description | Fwd Toe | Rear Toe | Fwd Heel | Rear Heel |
| 1 | High | 2 g | 10 g | 2 g | 10 g |
| 2 | Low | 10 g | 2 g | 10 g | 2 g |
| 3 | More Left | 2 g | 2 g | 10 g | 10 g |
| 4 | Left | 2 g | 10 g | 10 g | 2 g |
| 5 | Right | 10 g | 2 g | 2 g | 10 g |
| 6 | More Right | 10 g | 10 g | 2 g | 2 g |

Each weight configuration (i.e., 1 through 6) corresponds to a particular effect on launch conditions and, therefore, a struck golf ball's motion path. In the first configuration, the club head CG is in a center-back location, resulting in a high launch angle and a relatively low spin-rate for optimal distance. In the second configuration, the club head CG is in a center-front location, resulting in a lower launch angle and lower spin-rate for optimal control. In the third configuration, the club head CG is positioned to induce a draw bias. The draw bias is even more pronounced with the fourth configuration. Whereas, in the fifth and sixth configurations, the club head CG is positioned to induce a fade bias, which is more pronounced in the sixth configuration.

Figure 2:
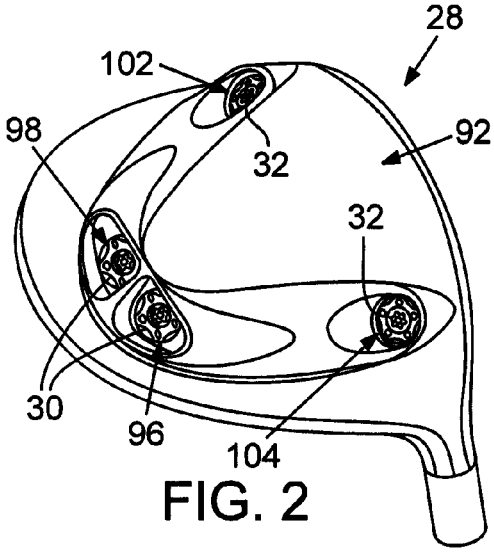
FIG. 2 is a bottom and rear side perspective view of a club head having four weight recesses.
Figure 3:
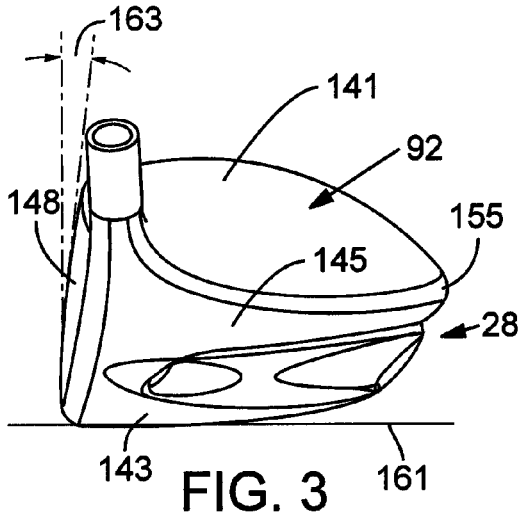
FIG. 3 is a side elevational view of the club head of FIG. 2, depicted from the heel side of the club head.
Figure 4:
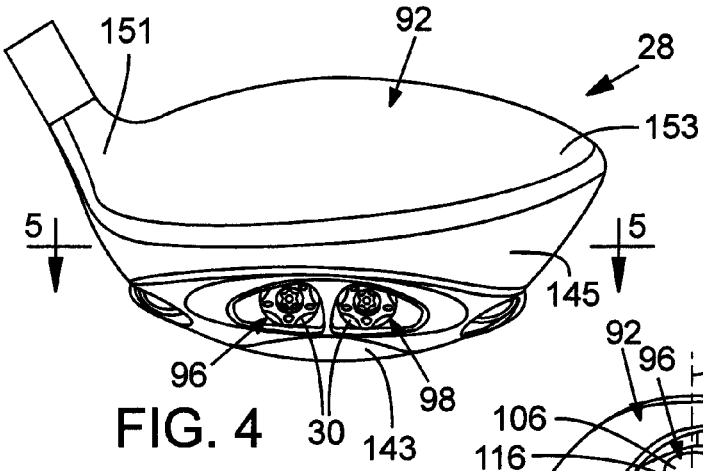
FIG. 4 is a rear elevational view of the club head of FIG. 2.

In use, the golfer selects, from the various motion path chart descriptions, the desired effect on the ball's motion path. For example, if hitting into high wind, the golfer may choose a golf ball motion path with a low trajectory, (e.g., the second configuration). Or, if the golfer has a tendency to hit the ball to the right of the intended target, the golfer may choose a weight configuration that encourages the ball's shot shape to the left (e.g., the third and fourth configurations). Once the configuration is selected, the golfer rotates the instruction wheel 26 until the desired configuration number is visible in the center window 42. The golfer then reads the weight placement for each of the four locations through windows 48, 50, 52, 53, as shown in the graphical representation 44 of the club head 28. The motion path description name is also conveniently shown along the outer edge 55 of the instruction wheel 26. For example, in FIG. 6, the instruction wheel 26 displays weight positioning for the "high" trajectory motion path configuration, i.e., the first configuration. In this configuration, two 10-gram weights are placed in the rear ports 96, 98 and two 2-gram weights are placed in the forward ports 102, 104 (FIG. 2). If another configuration is selected, the instruction wheel 26 depicts the corresponding weight distribution, as provided in Table 1, above.

Torque Wrench

Figure 7:
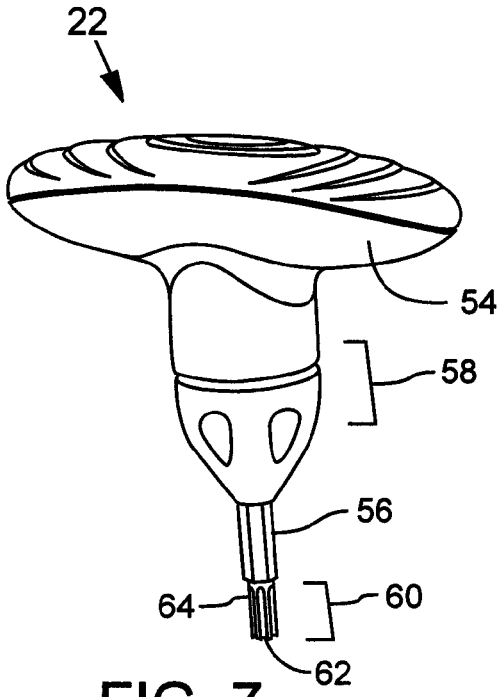
FIG. 7 is a perspective view of the tool of the kit of FIG. 1, depicting a grip and a tip.
Figure 8:
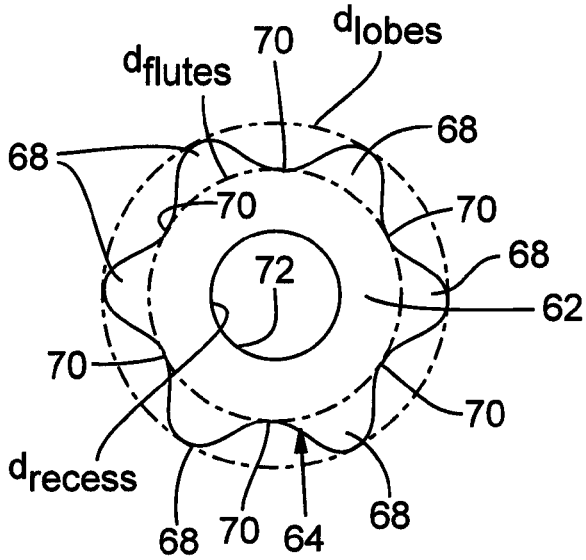
FIG. 8 is a close-up plan view of the tip of the tool of FIG. 7.

With reference now to FIGS. 7-8, the torque wrench 22 includes a grip 54, a shank 56, and a torque-limiting mechanism (not shown). The grip 54 and shank 56 generally form a T-shape; however, other configurations of wrenches can be used. The torque-limiting mechanism is disposed between the grip 54 and the shank 56, in an intermediate region 58, and is configured to prevent over-tightening of the weights 24 into the weight ports 96, 98, 102, and 104. In use, once the torque limit is met, the torque-limiting mechanism of the exemplary embodiment will cause the grip 54 to rotationally disengage from the shank 56. In this manner, the torque wrench 22 inhibits excessive torque on the weight 24 being tightened. Preferably, the wrench 22 is limited to between about twenty inch-lbs. and forty inch-lbs. of torque. More preferably, the limit is between twenty-seven inch-lbs and thirty-three inch-lbs of torque. In the exemplary embodiment, the wrench 22 is limited to about thirty inch-lbs. of torque. Of course, wrenches having various other types of torque-limiting mechanisms, or even without such mechanisms, can be used. However, if a torque-limiting mechanism is not used, care should be taken not to over-tighten the weights 24.

Figure 10:
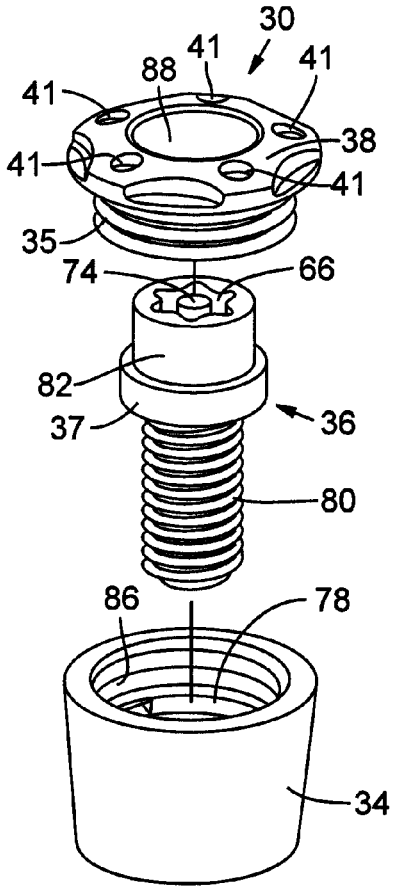
FIG. 10 is an exploded perspective view of a weight assembly of the kit of FIG. 1.
Figure 11:
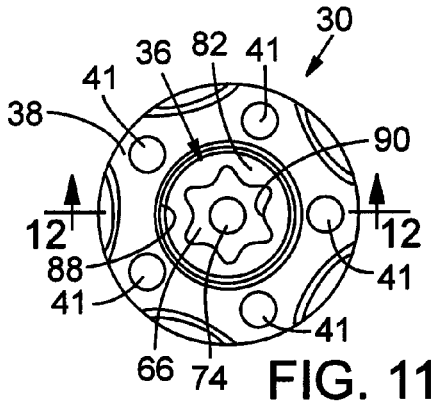
FIG. 11 is a top plan view of the weight assembly of FIG. 10.

The shank 56 terminates in an engagement end, i.e., tip 60, configured to operatively mate with the weight screws 32 and the weight assembly screws 36 (FIGS. 9-11). The tip 60 includes a bottom wall 62 and a circumferential side wall 64. As shown in FIGS. 9-11, the head of each of the weight screws 32 and weight assembly screws 36 defines a socket 124 and 66, respectively, having a complementary shape to mate with the tip 60. The side wall 64 of the tip 60 defines a plurality of lobes 68 and flutes 70 spaced about the circumference of the tip. The multi-lobular mating of the wrench 22 and the sockets 66 and 124 ensures smooth application of torque and minimizes damage to either device (e.g., stripping of tip 60 or sockets 66, 124). The bottom wall 62 of the tip 66 defines an axial recess 72 configured to receive a post 74 disposed in sockets 66 and 124. The recess 72 is cylindrical and is centered about a longitudinal axis of the shank 56.

With reference now to FIG. 8, the lobes 68 and flutes 70 are spaced equidistant about the tip 60, in an alternating pattern of six lobes and six flutes. Thus, adjacent lobes 68 are spaced about 60 degrees from each other about the circumference of the tip 60. In the exemplary embodiment, the tip 60 has an outer diameter ($d_{lobes}$), defined by the crests of the lobes 68, of about 4.50 mm, and trough diameter ($d_{flutes}$) defined by the troughs of the flutes 70, of about 3.30 mm. The axial recess has a diameter ($d_{recess}$) of about 1.10 mm. Each socket 66, 124 is formed in an alternating pattern of six lobes 90 that complement the six flutes 70 of the wrench tip 60.

Weights

Generally, as shown in FIGS. 1 and 9-12, weights 24, which in this implementation include weight assemblies 30 and weight screws 32, are non-destructively positionable about or within golf club head 28. In specific embodiments, the weights 24 can be attached to the club head 28, removed, and reattached to the club head without degrading or destroying the weights or the golf club head. In some embodiments, the weights 24 are accessible from an exterior of the golf club head 28.

In general, each of the weights 24 can include an outer end defined as an end of the weight proximate an exterior of the golf club head and an inner end defined as an end nearer an interior of the golf club than the outer end.

With reference now to FIG. 9, each weight screw 32 has a head 120, a body 122, a stop, or annular ledge 126, and a threaded portion 128. The weight screws 32 are preferably formed of titanium or stainless steel, and provide a weight with a low mass that can withstand forces endured upon impacting a golf ball with the club head 28. The combined masses of the head 120, body 122, stop 126 and threaded portion 128 can be defined as a total weight screw mass. The weight screw size, composition or combination of both can be varied to satisfy particular durability and mass requirements. For example, in some embodiments, the length of the weight screw 32 can be increased to increase the total weight screw mass. In other embodiments, the weight screw 32 can be formed of a heavier or more durable material to increase its mass or durability. In more specific embodiments, the size of the head 120, stop 126 and threaded portion 128 remain the same while adjustments to the length or width of the body are made to achieve an overall change to the total weight screw mass. For example, the body 122 can have a cross-sectional maximum dimension ($d_1$) that can be varied between about 4 mm and about 8 mm.

In some embodiments, the weight screw 32 can have an overall length ($L_1$) between about 18 mm and about 20 mm and a total mass between about 1 gram and about 5 grams. In one exemplary embodiment, the weight screw 32 has an overall length ($L_1$) of about 18.3 mm and a mass of about two grams. In another embodiment, the weight screw 32 has an overall length of about 19.5 mm and a mass of about 5 grams.

In the embodiment shown in FIG. 9, weight screw head 120 is sized to enclose the corresponding weight ports 96, 98, 102, 104 (FIGS. 2 and 5) of the club head 28, although this is not a requirement. In this way, a periphery of the weight screw head 120 generally abuts a side wall 106 of the ports, which helps prevent debris from entering the corresponding port. Preferably, the weight screw head 120 outer diameter ($d_3$) ranges between about 11 mm and about 13 mm, corresponding to weight port diameters of various exemplary embodiments. In specific embodiments, the outermost diameter ($d_3$) of the weight screw head 120 is between about 11 mm and about 12 mm or between about 12 mm and about 13 mm. In the illustrated embodiment, the weight screw head 120 has a diameter ($d_3$) of about 12.3 mm.

The weight screw head 120 defines a socket 124 having a multi-lobular configuration sized to operatively mate with the wrench tip 60. In some embodiments, the weight screw head 120 has an outer end surface that has a slightly domed shape. In other embodiments, the weight screw head outer end surface can include markings, such as markings corresponding to mass characteristics of the weight screw, e.g., the total mass of the weight screw 32. The markings may comprise text, colors, patterns or a combination thereof.

The annular ledge 126 is located in an intermediate region of the weight screw 32. The ledge 126 has a diameter ($d_2$) greater than that the diameter of the threaded openings 110 defined in the weight ports 96, 98, 102, 104 of the club head 28 (FIG. 2), thereby serving as a stop when the weight screw 32 is tightened. In the embodiment, the annular ledge 126 is a distance ($L_2$) of about 11.5 mm from an outer end of the weight screw head 120 and has a diameter ($d_2$) of about 6 mm. In other embodiments, the diameter ($d_2$) is approximately 8 mm. The threaded portion 128 is located below the annular ledge 126. In this embodiment, M5×0.6 threads (i.e., a thread outer diameter ($d_4$) of 5 mm and a thread pitch of 0.6) are used. The threaded portion 128 is configured to mate with the threaded openings 110 defined in the weight ports 96, 98, 102, 104 of the club head 28.

As shown in the chart of FIG. 9*a*, mass, material and dimension characteristics of various exemplary embodiments of weight screws (Examples A-D) are shown. The mass of each weight screw is the total mass of the weight screw and the dimension characteristics, including some ratios, refer to the weight screw dimensions referenced in FIG. 9.

Figure 12:
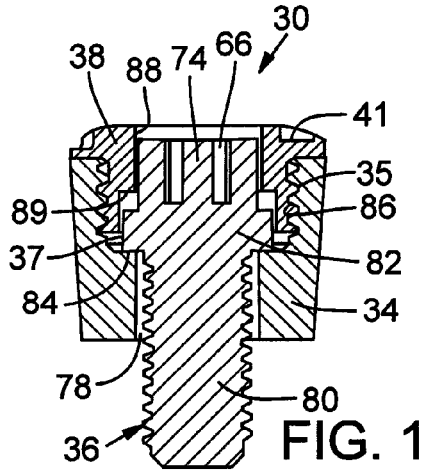
FIG. 12 is a cross-sectional view of the weight assembly of FIG. 10, taken along line 12-12 of FIG. 11.
Figure 10A:
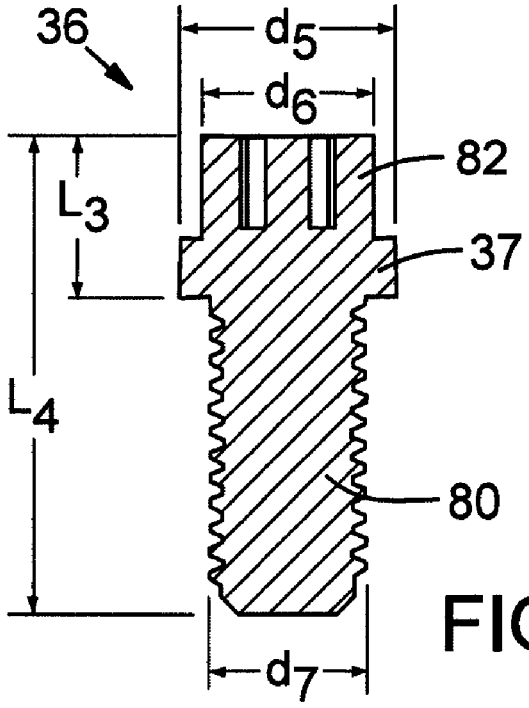
FIG. 10*a* is a side plan view of a weight assembly screw of the kit of FIG. 1.
Figure 10C:
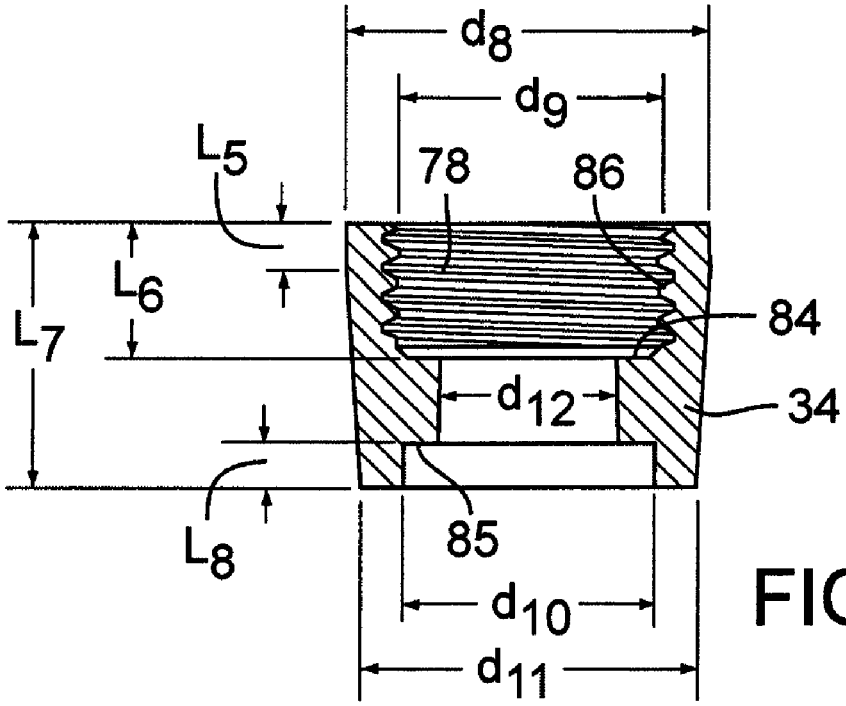
FIG. 10*c* is a cross-sectional view of a mass element.

With reference now to FIGS. 10-12, each mass element 34 of the weight assemblies 30 defines a bore 78 sized to freely receive the weight assembly screw 36 and at least a portion of the retaining element 38. As shown in FIG. 12, the bore 78 can be a stepped bore with a lower non-threaded portion and an upper threaded portion. An annular engagement surface, or shoulder 84, can be formed in the bore 78 where the upper portion transitions to the lower portion. The lower portion is sized sufficiently large to freely receive a weight assembly screw body 80 of screw 36, but not to allow the weight assembly screw head 82 to pass through the bore 78. In some embodiments, as shown in FIG. 10*c*, the lower portion can be stepped to include an upper segment and a lower segment having a cross-section larger than the upper segment. The lower portion can include a step 85 where the lower segment transitions to the upper segment. The upper portion of the bore 78 is sufficiently sized to at least partially receive the weight assembly screw head 82. More particularly, in some embodiments, the weight assembly screw head 82 includes a peripheral rim 37 that rests upon the shoulder 84 formed in the bore 78 when the weight assembly 30 is retained in the golf club head 28.

The upper portion of the bore 78 can have internal threads 86 for securing the retaining element 38. In some embodiments, the internal threads 86 have an outer diameter ($d_9$) of approximately 10 mm and a thread pitch of approximately 1.0. The upper portion of the bore can extend a length ($L_6$) from an outer end of the mass element 34. The lower non-threaded portion can have a diameter ($d_{12}$) of approximately 6 mm. In embodiments where the lower portion is stepped, the diameter of the upper segment can be the same as diameter ($d_{12}$) and a diameter ($d_{10}$) of the lower segment can be between approximately 6.0 and approximately 9.3 mm. In these embodiments, the lower segment can have a length ($L_8$) between approximately 2 mm and approximately 2.6 mm. In embodiments where the lower non-threaded portion is not stepped, it can be said that the length ($L_8$) is 0.0 mm. In some embodiments, the mass element 34 can have an overall length ($L_7$) between approximately 6 mm and approximately 15 mm.

In the illustrated embodiments, the weight assembly screw 36 has an overall length ($L_4$) between approximately 16 mm and approximately 22 mm. The weight assembly screw head 82 has a length ($L_3$) of approximately 5.5 mm. The peripheral rim 37 of the screw 36 has an outermost diameter ($d_5$) of approximately 7.4 mm and a height of approximately 2 mm. The portion of the weight assembly screw head 82 extending from the peripheral rim 37 has a diameter ($d_6$) of approximately 6 mm and a length ($L_9$) of approximately 3.5 mm. The screw 36 is typically made from a steel alloy, such as 17-4 stainless steel.

As shown in the chart of FIG. 10*b*, mass, material and dimension characteristics of weight assembly screws of various exemplary embodiments of weight assemblies (Examples E-X) are shown. The mass of each weight assembly screw is the total mass of the weight assembly screw and the dimension characteristics refer to the weight assembly screw dimensions referenced in FIG. 10*a*.

To facilitate a press fit in a recess formed in a golf club head, in some embodiments, the mass element 34 is conical frustum shaped with an outer sidewall surface tapering at an angle of approximately 95 degrees relative to a surface of the outer end of the mass element 34. In some embodiments, a portion of the outer sidewall surface extending from the outer end surface is not tapered and can have a length ($L_5$) between approximately 1 mm and approximately 5.5 mm. In those embodiments, where the outer sidewall surface does not include a portion that is not tapered, it can be said that the length ($L_5$) is 0.0 mm.

In some embodiments, the outer end of the mass element 34 has an outermost diameter ($d_8$) between about 11 mm and about 13 mm and the inner end of the mass element 34 has an outer most diameter ($d_{11}$) of approximately 11.2 mm. In the illustrated embodiments, the mass element 34 has a generally circular cross-sectional shape in a plane perpendicular to its axis. In other embodiments, the mass element 34 can have a generally triangular, hexagonal, oval, rectangular or other cross-sectional shape.

As shown in FIG. 10*d*, mass, material and dimension characteristics of mass elements of various exemplary embodiments of weight assemblies (Examples E-X) are shown. The mass of the each mass element is the total mass of the mass element and the dimension characteristics refer to the mass element dimensions referenced in FIG. 10*c*.

The retaining element 38 is typically made from a steel alloy, such as a 300-series stainless steel, a hardened stainless steel such as 17-4H900, or a similar material. The retaining element 38 can define a bore 88 sized to allow access to the screw socket 66 as well as retaining the screw 36 within the upper portion of the bore 78. The bore 88 can be a stepped bore having an upper portion and a lower portion. In the illustrated embodiment, the upper portion has a first diameter and the lower portion has a second diameter that is larger than the first diameter. In specific embodiments, the first diameter is approximately 6.0 mm and the second diameter is approximately 8.0 mm. As used herein, the term "bore" in connection with bore 78 and bore 88 refers to any through opening and is not restricted to openings having a circular cross-section.

In some embodiments, an annular engagement surface, or shoulder 89, can be formed in the bore 88 where the upper portion transitions to the lower portion. The first diameter of the upper portion is smaller than the outermost diameter of the peripheral rim 37 of the assembly screw head 82 and larger than the diameter of the portion of the head extending from the peripheral rim 37. The retaining element 38 can include external threads 35 corresponding to the internal threads 86 of the upper portion of the bore 78. In some embodiments, the retaining element 38 has an outer end surface that is slightly domed in shape. In other embodiments, the retaining element outer end surface can include markings corresponding to mass characteristics of the weight assembly, e.g., a total mass of the weight assembly.

Figure 5:
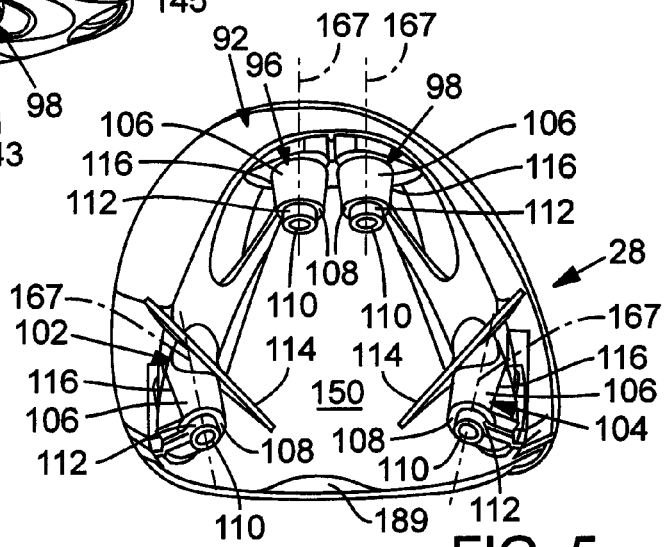
FIG. 5 is a cross-sectional view of the club head of FIG. 2, taken along line 5-5 of FIG. 4.

Similar to the weight screw head described above, the retaining element can have an outermost diameter sized such that a periphery of the retaining element 38 generally abuts the side wall 106 of the ports 96, 98, 102, 104 (FIGS. 2 and 5). In some embodiments, the retaining element outermost diameter is approximately equal to the mass element first end outermost diameter.

In assembling the weight assembly 30, the weight assembly screw 36 is inserted into the bore 78 of the mass element 34 such that the lower end of the weight assembly screw body 80 extends out the lower portion of the bore 78 and the weight assembly screw head 82 rests within the upper portion of the bore 78. The retaining element 38 is then coupled to the mass element 34 by threading the external threads 35 of the retaining element with the internal threads 86 of the mass element bore 78. In some embodiments, the outer end surface of the retaining element 38 includes tool receiving holes 41 or other features that engage a tool used to couple the retaining element 38 to the mass element 34. In certain embodiments, a thread locking compound can be used to secure the retaining element 38 to the mass element 34.

As shown in FIG. 12, the screw 36 is retained in the assembly 30 by capturing the peripheral rim 37 of the screw in a space between the mass element shoulder 84 and the retaining element shoulder 89. In other words, with the retaining element 38 in place, the screw 36 is allowed to rotate freely and move in the axial direction, but its axial movement in the inward direction is confined by engagement of the peripheral rim 37 with the shoulder 84 and its axial movement in the outward direction is confined by engagement of the peripheral rim 37 with the shoulder 89.

When assembled, the upper portion of the axial opening 88 exposes the socket 66 of the weight assembly screw head 82 and facilitates engagement of the wrench tip 60 in the socket 66 of the weight assembly screw 36. As mentioned above, the side wall of the socket 66 defines six lobes 90 that conform to the flutes 70 (FIG. 8) of the wrench tip 60. The cylindrical post 74 of the socket 66 is centered about the longitudinal axis of the screw 36. The post 74 is received in the axial recess 72 (FIG. 8) of the wrench 22. The post 74 facilitates proper mating of the wrench 22 and the weight assembly screw 36, as well as inhibiting use of non-compliant tools, such as Phillips screwdrivers, Allen wrenches, and so on.

In some embodiments of a weight assembly with a mass element made of a material with a density higher than the material density of the port, a sleeved mass element may be used. A mass element made of a higher density material such as tungsten may not properly seat or press fit into a port made of a lower density material such as steel or titanium. This is because the higher density material has a higher surface hardness than that of the lower density material and may not conform to potential surface imperfections that may be present in the lower density material.

Figure 13:
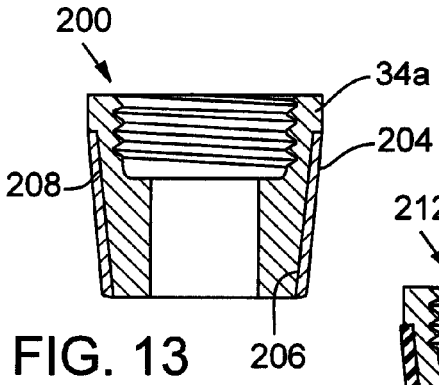
FIG. 13 is a cross-sectional view of a mass element having a high density sleeve.

As shown in FIG. 13, according to some embodiments, a sleeved mass element 200 includes a mass element 34*a* similar to the embodiments described above, except it is configured to receive and attach to an outer sleeve 204 made of a material with a lower density than the density of the mass element 34*a*. In some embodiments, the mass element 34*a* comprises a sleeve receiving portion 208 formed in the outer surface of the mass element. The sleeve receiving portion 208 can be an inwardly depressed surface of the mass element 202 sized to contact an inner surface of the sleeve 204. The sleeve 202 can be securely attached to the mass element 34*a* using an adhesive, such as, for example, bonding compound Loctite 680, or other joining methods as are commonly practiced in the field of golf club head manufacturing.

In some embodiments, the sleeve 204 has a generally thin sidewall ranging from about 0.3 mm to about 0.75 mm. In specific embodiments, the sidewall has a thickness of approximately 0.5 mm. The sidewall also defines a bore 206 sized to allow at least a portion of a sidewall of mass element 34*a* to extend through the bore 206 and nest against the inner surface of the sleeve sidewall. For example, in embodiments of a mass element 34*a* having a tapered sidewall portion, the sleeve 204 has a tapered sidewall corresponding with the tapered sidewall portion of the mass element 34*a* and nesting flush with the sleeve sidewall. Accordingly, the cross-sectional shape of the sleeve 204 corresponds to the cross-sectional shape of the mass element 34*a*.

The tapered sidewall of the sleeve 204 is shaped to correspond to the port wall 106 of the ports formed in the golf club head 28 such that the mass element 34*a* is secured within the port via a press fit. In certain embodiments of a golf club head with ports made of steel and a sleeved mass element 200 having a mass element 34*a* made of titanium and a sleeve 204 made of steel, the steel sleeve having a similar density to the steel ports will more readily conform to the inner surface of the ports and a proper seating or tighter press fit of the weight assembly 30 into a port can be achieved. Additionally, forming the sleeve 204 and a corresponding port wall 106 from similar materials may prevent the occurrence of galvanic corrosion at the interface between these components.

Figure 14:
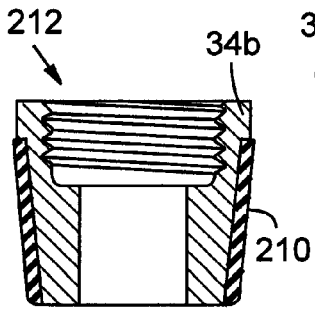
FIG. 14 is a cross-sectional view of a mass element having an elastomeric coating.

Similar to the sleeved mass element 200 described above, as shown in FIG. 14, some embodiments of the present application can include a coated mass element 212 having a coating 210 of an elastomeric material bonded to the mass element 202. In certain embodiments, the coating 210 is bonded to the tapered portion of the mass element sidewall. An elastomeric material coating 210 can promote an efficient press fit between the mass element 34*b* and a port formed in the golf club head 28 by deforming to compensate for misalignment or tolerance inconsistencies between the mass element 34*b* and ports that may be present. Furthermore, an elastomeric material coating 210 can promote a reduction in applied energy necessary to retain the weight assemblies 30 in the ports and to extract the weight assemblies 30 from the ports. In some embodiments, the elastomeric material can be a natural or synthetic rubber material. In certain embodiments, the elastomeric material has a thickness between about 0.15 mm and about 4.0 mm, or more preferably between about 0.25 mm and about 3.0 mm. In other certain embodiments, the elastomeric material may be Latex, SBR, Buna-N, Neoprene, nitrile rubber (NBR, Acrylonitrile-Butadiene rubber), Ethylene Propylene rubber (EPDM), or other similar material. In some embodiments, the elastomeric material may have a hardness of about Shore 40A to about Shore 90D, an elongation of about 300% to about 600%, a modulus of elasticity of about 0.003 Gpa, and a density of about 1.15 g/cm$^3$ to about 1.35 g/cm$^3$.

In embodiments using a torque control device, such as torque wrench 22, the torque control device controls the tightening of the weight assembly screw 36 through use of a torque limiting mechanism by setting the predetermined torque limit at which the screw 36 is properly preloaded, i.e., when a maximum clamp force of the screw is met. As will be described in more detail below, as the weight assembly screw 36 is tightened, an inner surface of the peripheral rim 37 of the screw interacts with the shoulder 84 of the mass element bore 78. The inner surface of the peripheral rim 37 and the shoulder 84 may be rough due to manufacturing processes. As the rough surfaces rotate against each other, applied energy from the torque wrench or other tool may dissipate in the form of friction resulting in the predetermined torque limit being met prior to the screw 36 reaching the proper preload which can result in inadequate tightening of the screw 36 to the golf club head.

Figure 15:
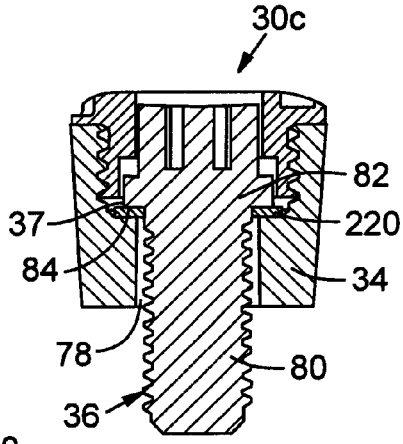
FIG. 15 is a cross-sectional view of the weight assembly of FIG. 10 having a washer.

In some embodiments of a weight assembly, as shown in FIG. 15, a weight assembly washer 220 can be positioned between the peripheral rim 37 of the weight assembly screw head 82 and the shoulder 84 of the mass element bore 78 to facilitate proper preload of the weight assembly screw 36 when installed in the golf club head 28. The washer 220 can be made from a material having a relatively high hardness, such as stainless steel. Further, the shape of the weight assembly washer 220 allows its major surfaces to have smoother surface finishes than the inner surface of the peripheral rim 37 and the shoulder 84. Employing a weight assembly washer 220 having a high hardness and a smooth surface can reduce torque energy dissipated due to friction. Accordingly, applying the predetermined torque limit will result in a more proper preload of the screw 36.

In some embodiments, the weight assembly washer 220 comprises a generally annular ring with an outer diameter greater than the diameter of the second portion of the bore 78 and less than the diameter of the first portion of the bore 78, and an inner diameter greater than the diameter of the weight assembly screw body 80 and less than the outermost diameter of the peripheral rim 37. In certain embodiments, the washer 220 has an outer diameter between approximately 7 mm and approximately 8 mm and an inner diameter between approximately 5 mm and approximately 6 mm. In other certain embodiments, the washer 220 has a thickness of approximately 0.5 mm and a surface finish of approximately 1.0 microns.

Club Head

As illustrated in FIGS. 2-5, a golf club head 28 of the present application includes a body 92. The body 92 can include a crown 141, sole 143, skirt 145 and face plate 148 defining an interior cavity 150. The body further includes a heel portion 151, toe portion 153 and rear portion 155.

The crown 141 includes an upper portion of the golf club head 28 above a peripheral outline of the head and top of the face plate 148.

The sole 143 includes a lower portion of the golf club head 28 extending upwards from a lowest point of the club head when the club head is ideally positioned, i.e., at a proper address position. For a typical driver, the sole 143 extends upwards approximately 15 mm above the lowest point when the club head is ideally positioned. For a typical fairway wood, the sole 143 extends upwards approximately 10 mm to about 12 mm above the lowest point when the club head is ideally positioned. A golf club head, such as the club head 28, can be ideally positioned when angle 163 measured between a plane tangent to the an ideal impact location on the face plate and a perfectly vertical plane relative to the ground is approximately equal to the golf club head loft and when the golf club head lie angle is approximately equal to an angle between a longitudinal axis of the hosel or shaft and the ground 161. The ideal impact location is disposed at the geometric center of the face plate. The sole 143 can also include a localized zone 189 proximate the face plate 148 having a thickness between about 1 mm and 3 mm, and extending rearwardly away from the face plate a distance greater than about 5 mm.

The skirt 145 includes a side portion of the golf club between the crown and the sole that extends across a periphery of the golf club head, excluding the face plate, from the toe portion 153, around the rear portion 155, to the heel portion 151.

The crown, sole and skirt can be integrally formed using techniques such as molding, cold forming, casting, and/or forging and the face plate can be attached to the crown, sole and skirt by means known in the art. Furthermore, the body can be made from a titanium and/or steel alloy, composite material, ceramic material, or any combination thereof.

With reference again to FIGS. 2-5, the club head 28 can include a thin-walled body 92 and a face plate 148.

The weights 24 of the present application can be accessible from the exterior of the club head 28 and securely received into the weight ports 96, 98, 102, and 104. Weight ports can be generally described as a structure coupled to the golf club head crown, golf club head skirt, golf club head sole or any combination thereof that defines a recess, cavity or hole on, about or within the golf club head. The four ports 96, 98, 102, and 104 of the club head 28 are positioned low about periphery of the body 92, providing a low center of gravity and a high moment of inertia. More particularly, first and second recesses 96, 98 are located in a rear portion 155 of the club head 28, and the third and fourth recesses 102 and 104 are located in a toe portion 154 and a heel portion 152 of the club head 28, respectively. Fewer, such as two or three weights, or more than four weights may be provided as desired.

The ports 96, 98, 102, and 104 are each defined by a port wall 106 defining a weight cavity 116 and a port bottom 108. In embodiments of a weight having a mass element with tapered outer surfaces, the port wall 106 is correspondingly tapered to receive and secure the mass element in place via a press fit. The port bottom 108 defines a threaded opening 110 for attachment of the weights 24. The threaded opening 110 is configured to receive and secure the threaded portion of the weight assembly screw body 80 and weight screw threaded portion 128. In this embodiment, the threaded bodies 80 and 128 of the weight assembly 30 and weight screw 32, respectively, have M5×0.6 threads. In other embodiments, the thread pitch is about 0.8. The threaded opening 110 may be further defined by a boss 112 extending either inward or outward relative to the weight cavity 116. Preferably, the boss 112 has a length at least half the length of the body 80 of the weight assembly screw 36 and, more preferably, the boss 112 has a length 1.5 times a diameter of the body of the screw. As depicted in FIG. 5, the boss 112 extends outward, relative to the weight cavity 116 and includes internal threads (not shown). Alternatively, the threaded opening 110 may be formed without a boss 112. The ports have a weight port radial axis 167 defined as a longitudinal axis passing through a volumetric centroid, i.e., the center of mass or center of gravity, of the weight port.

As depicted in FIG. 5, the club head 28 can include fins 114 disposed about the forward weight ports 102 and 104, to provide support within the club head and reduce stresses on the golf club head walls during impact with a golf ball. In this embodiment, the club head 28 has a volume of about 460 cc and a total mass of about 200 grams, of which the face plate 148 accounts for about 24 grams. As depicted in FIG. 2, the club head 28 is weighted in accordance with the first configuration (i.e., "high") of Table 1, above. With this arrangement, a moment of inertia about a vertical axis at a center of gravity of the club head 28, $I_{zz}$, is about 405 kg-mm$^2$.

To attach a weight assembly, such as weight assembly 30, in a port of a golf club head, such as the club head 28, the threaded portion of the weight assembly screw body 80 is aligned with the threaded opening 110 of the port. With the tip 60 of the wrench 22 inserted through the aperture 88 of the retaining element 38 and engaged in the socket 66 of the weight assembly screw 36, the user rotates the wrench to screw the weight assembly 30 in place. Torque from the engagement of the weight assembly screw 36 provides a press fit of the mass element 34 to the port. As sides of the mass element 34 slide tightly against the port wall 106, the torque limiting mechanism of the wrench 22 prevents over-tightening of the weight assembly 30. Similarly, in embodiments using a sleeved mass element, the outer surface of the sleeve achieves a tight fit against the port wall 106.

Weight assemblies 30 are also configured for easy removal, if desired. To remove, the user mates the wrench 22 with the weight assembly 30 and unscrews it from a club head. As the user turns the wrench 22, the head 82 of the weight assembly screw 36 applies an outward force on the shoulder 89 of the retaining element 38, thereby extracting the mass element 34 from the weight cavity 116. In some embodiments, a low friction material, such as PTFE or similar material, can be provided on surfaces of the retaining element 38 and the mass element 34 to facilitate free rotation of the head 82 of the weight assembly screw 36 with respect to the retaining element 38 and the mass element 34.

Similarly, a weight screw, such as weight screws 32, can be attached to the body through a port by aligning the threaded portion of weight 32 with the threaded opening 110 of the port. The tip of the wrench can be used to engage the socket of the weight by rotating the wrench to screw the weight in place.

Although conventional threaded type connections between screws 36, 32 and the threaded opening 110 of the port, and the between the retaining element 38 and the mass element 34, have been forthwith described, other sorts of coupling methods allowing assembly and disassembly of concentric elements could also be used.

Various other designs of club heads and weights may be used, such as those disclosed in Applicant's U.S. Pat. No. 6,773,360, which is herein incorporated by reference. Furthermore, other club head designs known in the art can be adapted to take advantage of features of the present invention.

Having illustrated and described the principles of the disclosed embodiments, it will be apparent to those skilled in the art that the embodiments can be modified in arrangement and detail without departing from such principles. In view of the many possible embodiments, it will be recognized that the described embodiments include only examples and should not be taken as a limitation on the scope of the invention. Rather, the invention is defined by the following claims. We therefore claim as the invention all possible embodiments and their equivalents that come within the scope of these claims.

We claim:

1. A weight for a golf club head comprising:

a head having a region configured for engagement with a tool for securing the weight to the golf club head;

an elongate body having a first end connected to the head and an opposite second end;

a stop positioned on the body between the first end and the second end and having a lateral dimension, the stop being configured to prevent an axial movement when the weight is secured; and an intermediate portion of the body extending from the stop and toward the head, the intermediate portion having a lateral dimension less than the stop lateral dimension.

2. The weight of claim 1, wherein the body has a diameter and the head has a diameter, and wherein the diameter of the body is less than the diameter of the head and the lateral dimension of the stop.

3. The weight of claim 2, wherein the diameter of the head is greater than the lateral dimension of the stop.

4. The weight of claim 1, wherein the weight has a total weight mass equal to the combined masses of the head, body, stop and protruding portions.

5. The weight of claim 4, wherein the total weight mass is changed by lengthening or widening the mass of the body.

6. The weight of claim 4, wherein the total weight mass is between approximately 1gram and approximately 5grams.

7. The weight of claim 6, wherein the total weight mass is approximately 2grams.

8. The weight of claim 1, wherein the head comprises an outer end surface having markings thereon corresponding to mass characteristics of the weight.

9. The weight of claim 1, wherein the weight is made from a titanium or steel.

10. The weight of claim 1, wherein a length of the weight is between approximately 18 mm and approximately 20 mm.

11. The weight of claim 1, wherein the weight head is sized to enclose a corresponding weight recess formed in the golf club head.

12. The weight of claim 11, wherein the weight head comprises an outermost diameter between about 12 mm and about 13 mm.

13. The weight of claim 11, wherein the weight head comprises an outermost diameter between about 11 mm and about 12 mm.

14. The weight of claim 1, wherein the head region defines multiple lobes and corresponding flutes to facilitate engagement with the tool.

15. The weight of claim 14, wherein the head region comprises a centrally located post to facilitate engagement with the tool.

16. The weight of claim 1, wherein the stop is positioned on the weight at a distance of about 11 mm from an outer end surface of the head.

17. The weight of claim 1, wherein the stop lateral dimension is about 6 mm.

18. The weight of claim 1, wherein the stop lateral dimension is a stop diameter.

19. The weight of claim 18, wherein the intermediate portion lateral dimension includes a diameter that is about 6 mm.

20. The weight of claim 1, wherein the weight is configured to be removably engaged with the golf club head.

21. The weight of claim 1, wherein the body comprises a cross-sectional maximum dimension between about 4 mm and about 8 mm.

* * * * *